United States Patent [19]

Hickman

[11] 4,076,229

[45] * Feb. 28, 1978

[54] WORKBENCHES

[75] Inventor: Donald Price Hickman, Waltham Abbey, England

[73] Assignee: Inventec International Limited, Point Robert, Guernsey (Channel Is.)

[ * ] Notice: The portion of the term of this patent subsequent to Oct. 26, 1988, has been disclaimed.

[21] Appl. No.: 642,743

[22] Filed: Dec. 22, 1975

Related U.S. Application Data

[60] Continuation of Ser. No. 495,265, Aug. 7, 1974, abandoned, which is a division of Ser. No. 177,123, Sept. 1, 1971, Pat. No. 3,841,619, which is a division of Ser. No. 803,600, March 3, 1969, Pat. No. 3,615,087.

[30] Foreign Application Priority Data

Mar. 4, 1968 United Kingdom ..... 10484/68

[51] Int. Cl.[2] ..... B25B 1/10

[52] U.S. Cl. ..... 269/139; 269/219; 269/244; 269/321 CF

[58] Field of Search ..... 269/219, 220, 221, 244, 269/258, 222, 139, 321

[56] References Cited

U.S. PATENT DOCUMENTS

| | | | |
|---|---|---|---|
| 101,126 | 3/1870 | Hayes | 269/113 |
| 300,178 | 6/1884 | Williams | 269/289 |
| 732,585 | 6/1903 | Reinhardt | 108/19 |
| 968,038 | 8/1910 | Everest | 269/220 |
| 982,093 | 1/1911 | Russ | 108/121 |
| 985,857 | 3/1911 | Thomas | 269/222 |
| 1,246,438 | 11/1917 | Lagerback | 269/221 |
| 1,328,492 | 1/1920 | Carman | 144/12 |
| 1,403,958 | 1/1922 | Holman | 269/220 |
| 1,652,802 | 12/1927 | Smith | 269/165 |
| 1,716,718 | 6/1929 | Castagna | 269/221 |
| 2,233,760 | 3/1941 | Wertz | 269/221 |
| 2,541,508 | 2/1951 | Fleming | 144/286 |
| 2,629,924 | 3/1953 | Kauper | 269/222 |
| 3,060,917 | 10/1962 | Dickey | 125/35 |
| 3,615,087 | 10/1971 | Hickman | 269/139 |
| 3,841,619 | 10/1974 | Hickman | 269/220 |

FOREIGN PATENT DOCUMENTS

| | | |
|---|---|---|
| 159,875 | 8/1952 | Australia. |
| 1,111,118 | 7/1961 | Germany. |
| 1,025,120 | 4/1966 | United Kingdom. |

OTHER PUBLICATIONS

The Practical Wood Worker, Bernard E. Jones, p. 497, Figures 71 and 72.

*Primary Examiner*—Neil Abrams
*Attorney, Agent, or Firm*—Brumbaugh, Graves, Donohue & Raymond

[57] ABSTRACT

A workbench of saw-horse height has its top formed by a pair of longitudinally extending top members which form a working surface and which are carried by transverse supports. One of the top members is fixed with respect to the supports but the other is horizontally movable towards and away from the fixed top member to form a vice between the opposed vertical faces of the top members. Adjacent each end the top members are interconnected by screw threaded rods which are restrained against axial movement at their ends adjacent the fixed top members but which are received in nuts connected to the movable top member. The connection of the nut to the movable top member allows independent operation of the screw threaded rods to permit the gap between the vertical faces to be greater at one end than at the other.

68 Claims, 7 Drawing Figures

WORKBENCHES

This is a continuation of application Ser. No. 495,265 filed on Aug. 7, 1974 and now abandoned, which in turn was a division of application Ser. No. 177,123 filed on Sept. 1, 1971 and issued as U.S. Pat. No. 3,841,619 on Oct. 15, 1974, which in turn was a division of application Ser. No. 803,600 filed on Mar. 3, 1969 and issued as U.S. Pat. No. 3,615,087 on Oct. 26, 1971.

This invention relates to workbenches and is concerned with the provision of an arrangement wherein the bench has a vice incorporated as part of its basic structure. With many applications it is desirable to be able to clamp up an elongated timber or other workpiece but prior proposals have not enabled this to be done in a satisfactory manner. Specifically it has not been possible readily to clamp up a tapered workpiece.

According to one aspect of the present invention a workbench includes a supporting structure bearing a pair of top members having upper surfaces lying in substantially the same plane, e.g. to form a working surface, at least one of the top members being movable with respect to the other to cause opposed substantially vertical faces thereof to be moved relatively towards and away from one another, said movement being caused by actuation of one or both of a pair of spaced clamping devices which are capable of independent operation to permit the gap between the vertical faces to be greater at one end than at the other.

According to one convenient arrangement the pair of top members between them afford the complete working surface of the bench. Thus the arrangement may be such that one top member is securely fixed to the supporting structure whilst the other top member is mounted for horizontal movement towards and away from the fixed top member. In an alternative construction a third top member may be included which is disposed on the side of the movable top member remote from the first, the third top member being rigidly secured to the supporting structure.

The supporting structure conveniently incorporates a pair of horizontal transverse supports to which one top member is securely fixed, the transverse supports affording horizontal slideways upon which the movable top member can bear during its movement. The transverse supports may take various forms but conveniently each may comprise an inverted channel member within which screw threaded devices are mounted, the movable top member being secured to slider members located by the channel members for substantially longitudinal movement with respect thereto. For example in this case the screw threaded devices may comprise screw threaded rods extending substantially at right angles to the vertical face of the stationary to member, and co-operating with screw threaded bores of associated slider members.

In order to allow the gap between the vertical faces to be greater at one end than the other the top member is preferably secured to the slider members by securing means which permit relative rotation about a vertical axis. However, where the top supports are channel members, the slider members may be located for longitudinal movement with respect to the channel members, e.g. by co-operating projections and slots provided respectively thereon, but preferably the slider members are located such that they can move laterally slightly with respect to the channels. Thus the slider member may have a projection which is laterally of a width which is less than the width of a locating slot provided by the channel member. This will permit the arcuate movement of an end (or both ends) of the movable top member. It will be appreciated that the same effect can be obtained in other ways, e.g. by relative movement between the associated slider member and means by which it is secured to the top member. Alternatively the relative movement could occur between the said securing means and the top member itself. A further possibility of allowing for the arcuate movement would be to permit the screw thread devices to move translationally at their ends opposite to the ends which co-operate with the slider members.

The supporting structure may include a base structure interconnected with the top members by supporting members which are capable of movement between a collapsed position in which the top members are in closed juxtaposition to the base structure and a working position in which the top members are spaced from and supported by the base structure.

The screw threaded rods are conveniently actuated by crank handles which each may be formed in two hinged sections to allow the crank to be folded for storage.

The invention may be carried into practice in a number of ways but two specific embodiments will now be described by way of example with reference to the accompanying drawings in which.

Figure 1:
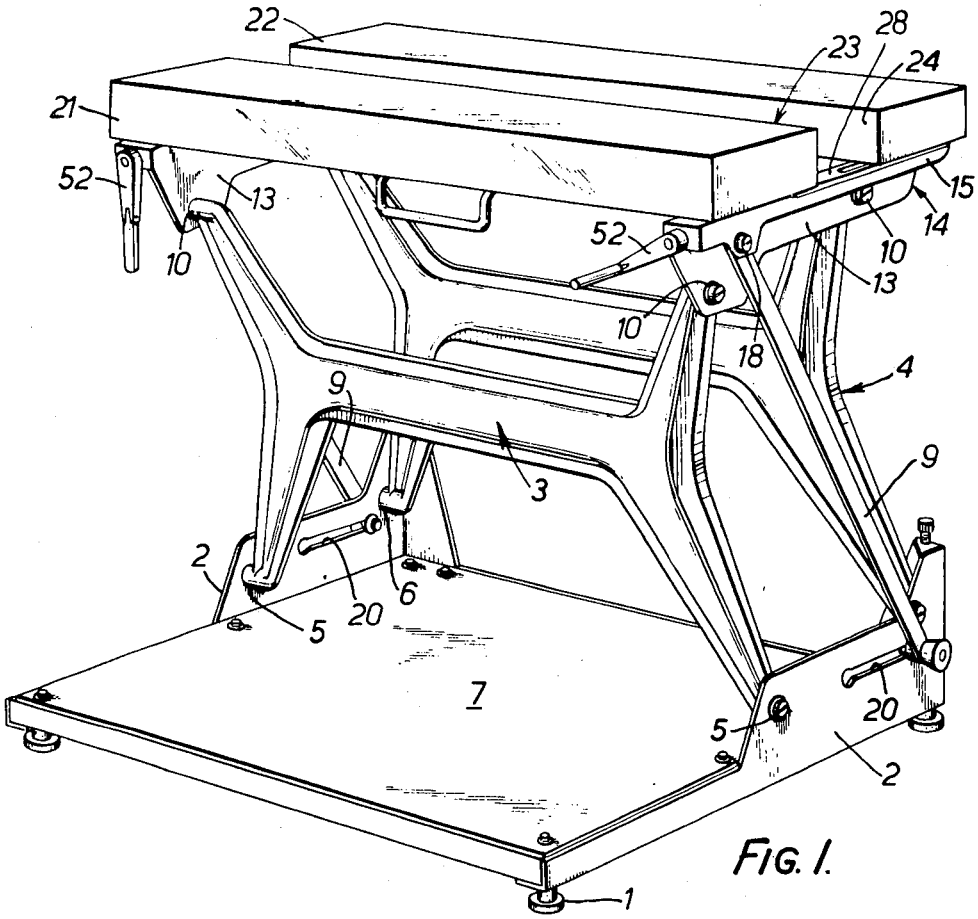
FIG. 1 is a perspective view of one form of collapsible workbench constructed in accordance with the present invention.

FIG. 1 shows the general construction of a workbench having a base structure incorporating a foot-thrust member or baseboard 7 upon which a person can stand and stabilize with his weight the entire workbench. The baseboard 7 is mounted on adjustable feet 1 and provided at each end with a supporting bracket 2 by which a pair of generally 'H' shaped frames 3 and 4 are pivotally mounted at 5 and 6 respectively for movement between the working position of FIG. 1 and a collapsed storage position in which the top members are in close juxtaposition to the base board.

Figure 3:
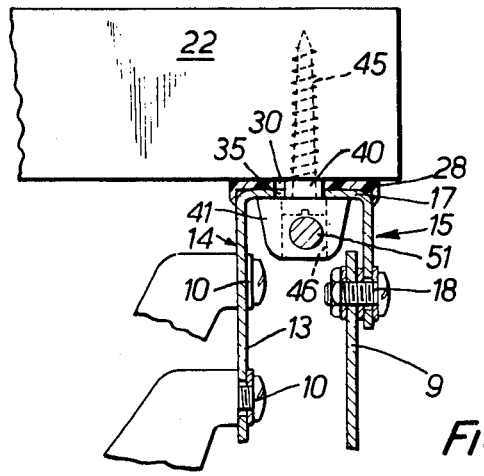
FIG. 3 is a front part-sectional elevation of the workbench of FIGS. 1 and 2.
Figure 2:
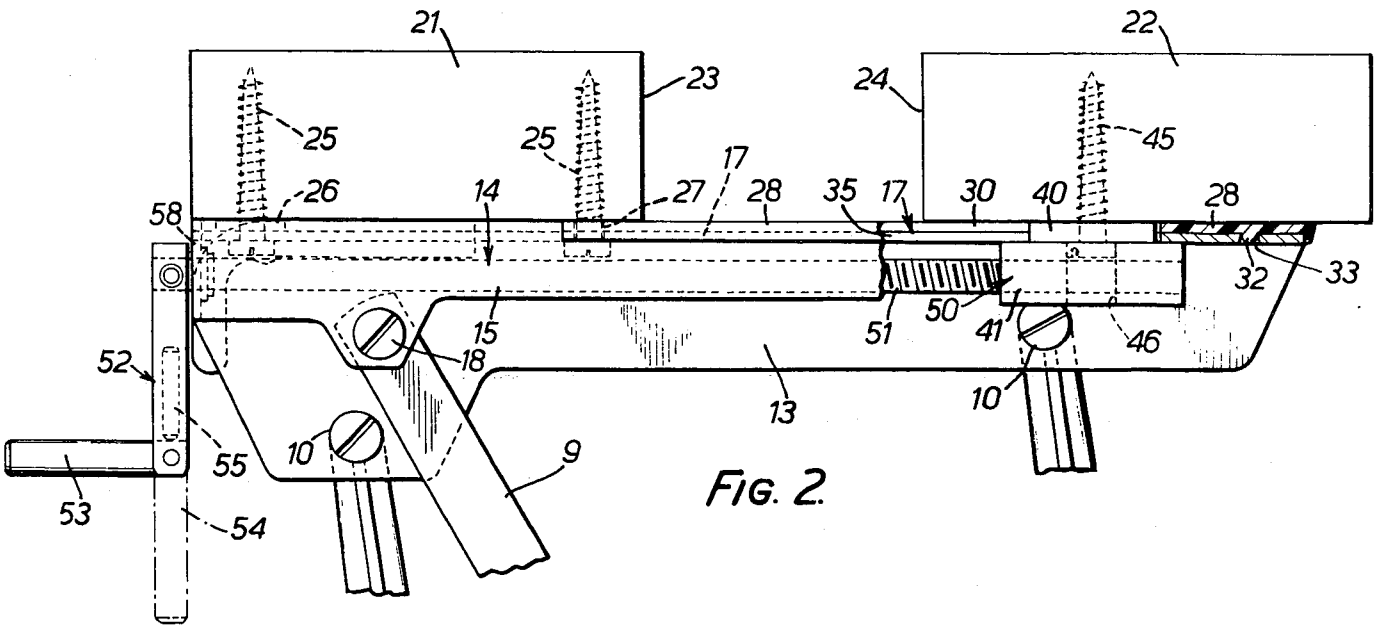
FIG. 2 is an end elevation, partly in section, of the upper end of the workbench showing the manner in which the top members act as a vice.

The upper ends of the frames 3 and 4 each afford a pair of spaced limbs which are pivoted at 10 to a vertical web 13 of a generally 'U' shaped inverted channel 14 the detailed form of which is shown in FIGS. 2 and 3. Thus, referring to FIG. 3 the channel 14 also includes a vertical web 15 situated externally of the web 13, the two webs 13 and 15 being interconnected by a further horizontal web 17. The diagonal bars 9 are secured to the webs 15 at pivot points 18 at their upper ends and at their lower ends co-operate with slots 20 to allow for collapsing of the workbench.

Figure 5:
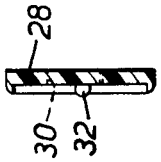
FIG. 5 is a cross-section of the slideway on the line T—T of FIG. 4.
Figure 4:
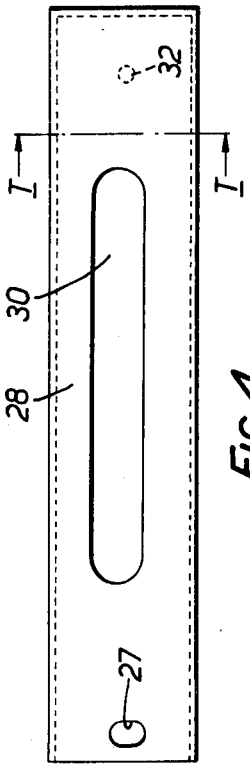
FIG. 4 is a plan view of a slideway incorporated in the workbench.
Figure 6:
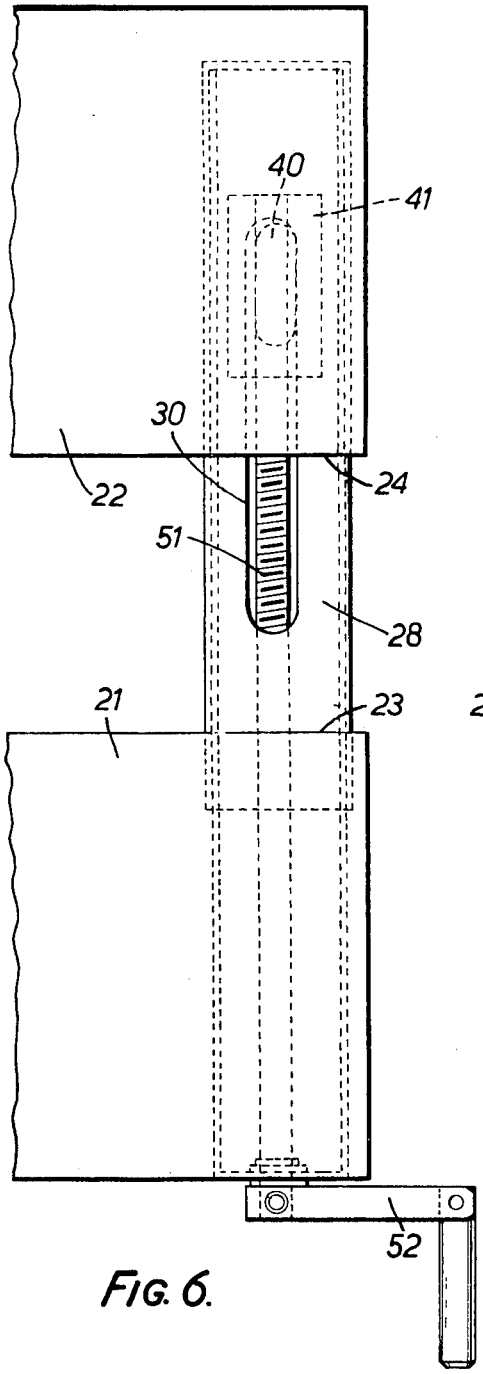
FIG. 6 shows certain parts of the workbench in plan with the pair of top members of the bench in parallel spaced relationship.

The work surface of the workbench is afforded by a pair of spaced rectangular-section timber beams 21 and 22 having their horizontal surfaces aligned in the same plane. The beams also have opposed vertical clamping faces or surfaces 23 and 24 respectively both of which extend vertically less than one half the front-to-back dimension of the upper horizontal surfaces, as shown in FIG. 2. The clamping faces 23 and 24, as will be described, can be drawn towards one another from their spaced apart positions of FIGS. 1, 2 and 6. As shown in FIGS. 3 and 6, the ends of the beams or vise members 21 and 22 overhang the channel or support members 14 to provide a gap between the vise members at their lateral ends which is clear of underlying structure. At each end the front beam 21 is rigidly connected to the horizontal web 17 of the respective channel by means of a pair of screws 25 as shown in FIG. 2, the front screw having a spacer washer 26 surrounding it between the beam and the web 17, and the rear screw 25 passing through a hole 27 in a slideway 28 formed for example of nylon or metal strip provided with a PTFE upper surface. The form of slideway is shown in detail in FIGS. 4 and 5. Apart from the hole 27 for the rear screw 25, it has a longitudinal slot 30 for a purpose to be described, and at its rear end is provided with a poppet stud 32 which, as shown in FIG. 2, is received in an aperture 33 in the horizontal web 17 of the channel 14.

The horizontal web 17 is provided with a longitudinal slot 35 of a shape corresponding to the slot 30 in the slideway and the two slots 30 and 35 have extending upwardly through them a projecting portion 40 formed on a slider member 41 shown in FIGS. 2 and 3. The upper surface of the projection 40 abuts the underside of an end of the rear beam 22 and the slider member 41 is secured to the beam 22 at each end by a single screw 45, for which purpose the underside of the slider member 41 is provided with an open recess 46, as shown in FIG. 3.

As shown in FIG. 3 the slider member 41, below the web 17, is substantially wider than the width of the slots 30 and 35 so that the rear beam 22 whilst it can ride freely in a horizontal manner along the slideway, is prevented from moving bodily upward or of tilting upwards, e.g. adjacent its front edge. It is to be noted from FIG. 3 that the width of the projection 40 of the slider member 41 is less than the width of the slots 30 and 35 to allow for lateral movement of the slider member in a manner to be described. For this purpose also the width of the lower, wider part of the slider member 41 is less than the width of the space between the webs of the channel 14.

As shown in FIG. 2, on each side of the recess 46 the slider member 41 has a screw threaded bore 50 which co-operates with an externally screw threaded device such as the rod 51, the outer end of which, to the left in FIG. 2, carries a crank handle 52 provided with a hinged end section 53 which can be maintained either in the position shown in FIG. 2 for operating purposes or hinged downwards to the dotted line position 54 against the action of a spring biassed plunger 55 when not in use. In order to support the end of the rod 51 adjacent its handle 52 the webs 13 and 15 of the channel 14 are interconnected at the front by a transverse wall 58 through which the rod 51 passes, washers being provided on each side of the wall 58 and the rod being held in position by means of a circlip.

Accordingly, rotation of the rod 51 by means of its cranked handled 52 will cause horizontal movement of the slider member 41 towards or away from the front beam 21. The extent of movement of the slider member 41 is determined in one direction by abutment of the beams 21 and 22 against one another or in the case of rearward movement of the beam 22 by abutment of the projection 40 of the slider member 41 against the rear end of the slots 30 and 35. As shown in FIG. 1 the beams 21 and 22 can be drawn together or moved apart by simultaneous or independent operation of identical screw threaded rods at each end by means of a pair of crank handles 52. In this way, therefore, the beams 21 and 22, apart from providing substantially horizontal surfaces, which together provide a working top surface upon which many operations can be carried out, also act in the manner of a vice between which lengths of timber or other material can be clamped. It will accordingly be apparent that each threaded rod and its cooperating slider member 41 constitutes an extensible and contractible clamping device, and the two relatively spaced clamping devices are operable independently of each other to permit angular adjustment of the movable top member 22 about either of the vertical axes defined by the respective screws 45.

Figure 7:
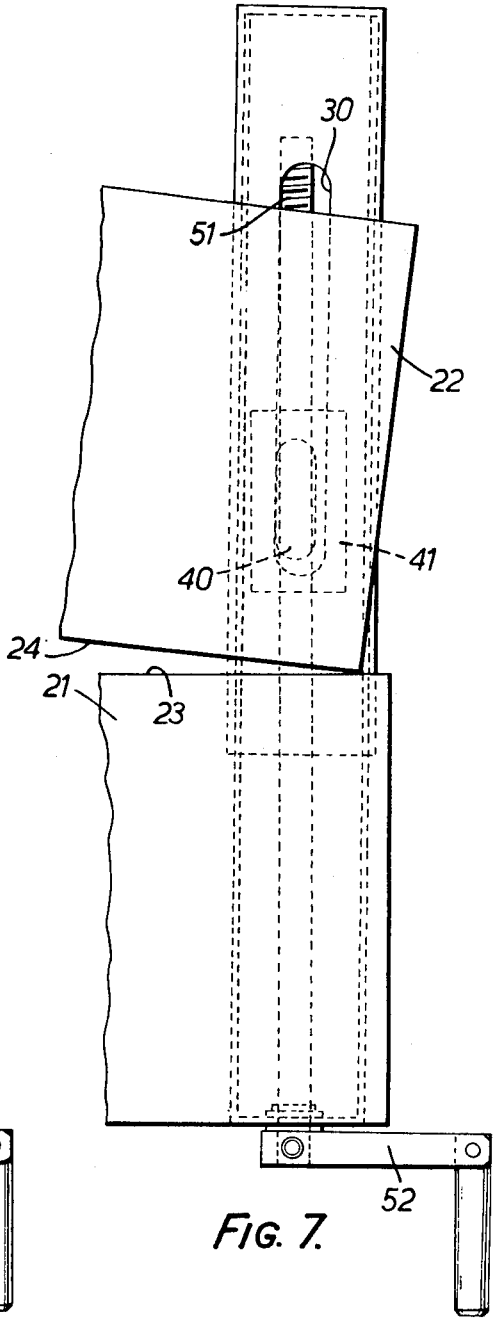
FIG. 7 is a scrap plan view showing one end of the workbench with one of the top members drawn into contact with the other top member at one end only.

Assuming that the beams 21 and 22 are initially in spaced parallel relationship as shown for example in FIGS. 1 and 2 equal rotation of the crank handles at each end will cause the beams to be maintained in parallel relationship but it is a particular feature of this workbench that one or other of the handles 52 can be operated quite independently of the other to the maximum limits allowed by movement of the respective slider members 41. In other words one end of the rear beam 22 may be fully separated from the front beam 21 and remain so whilst the other end of the rear beam 22 is drawn up fully into contact with the front beam 21. This extreme position is shown in FIG. 7. It will be appreciated that during such independent movement of only one end of the beam 22, the beam will pivot at each end about the screws 45 by which it is secured to the two slider members 41. Assuming the extreme example mentioned above where one of the ends of the beam remains stationary, full clamping up for example of the right-hand end of the beam 22, with no movement of the lefthand end, in the manner shown in FIG. 7, will of necessity require the slider member 41 on the right to move to the left due to the arcuate movement of the right-hand end of the rear beam 22. Such sideways movement of the slider member 41 is accommodated by the excess width of the slots 30 and 35 in relation to the width of the projection 40 of the slider member 41 as shown and described with respect to FIG. 3. FIGS. 6 and 7 demonstrate this lateral movement of the slider member 41 between its extreme positions. Thus in FIG. 6 the outline of the projection 40 of the slider member 41 is shown as engaging the right-hand face of the elongated slot 30 in the slidway 28. After full clamping up to the position shown in FIG. 7 the projection 40 of the slider member 41 moves laterally to engage the lefthand side of the slot 30. Of necessity in this arrangement the slider member 41 has to tilt slightly with respect to the longitudinal axis of the slot 30 in the clamped up position of FIG. 7. This will cause slight lateral movement of the rear end of the screw threaded rod 51 as shown in FIG. 7 in a horizontal arc about a vertical axis through the connection of the rod at its front end where it passes through the transverse wall 58. This swinging movement of the rod 51 can be readily accommodated by means of the tolerances in the manner of mounting of the rod 51 at its front end.

It will be appreciated that the relative dispositions of the parts in FIGS. 6 and 7 show an extreme condition in which a full 3" closure of the beams has occurred at one end. In most instances such an extreme condition will not be required and there will usually be some clamping up at both ends either to the same or a different extent. The manner in which the slider members 41 are mounted to permit this independent movement avoids any difficulty of seizure of one or other of the screw threaded rods during clamping up or release as would normally be expected to occur with spaced screw threaded members of this type. Normally with spaced screw threaded members it is necessary to maintain substantially equal rotation of each in order to prevent seizure. The use of a pair of spaced screw threads of which one can be in tension thus applying a compressional load on a part clamped between the vertical faces, and the other can, if desired, take a reaction load in compression, is particularly useful for the clamping up of short parts. This is especially so where the point of grip of the part is outboard of one of the screw threads.

Accordingly, the workbench according to the invention enables a part to be clamped up within the space between the two beams irrespective of whether its side faces are parallel or inclined to one another.

Whilst with the embodiment of FIGS. 1 to 7 the screw threaded rods 51 are used in tension for clamping 70, this is not essential and compression screws could be used.

Whilst the twin screws have been described as being entirely independently operable it is envisaged that it may be possible to provide an optional link between them when it is desired that they should maintain the pair of top members in constant alignment. Equally it is envisaged that each screw may be provided with a quick release in order that the members can be drawn together or moved apart separately for coarse adjustment prior to clamping up.

What I claim as my invention and desire to secure by Letters Patent is:

1. A workbench comprising:

a first vise member and a second vise member, both members having opposed vertical clamping faces and lying in side by side relationship to provide a clamping space which is open topped and open ended, each of said vise members having a flat upper surface, both of said surfaces lying in substantially the same plane;

clamping means for relatively moving the members translationally towards and away from one another and angularly in a horizontal plane;

said clamping means including two independently operable devices;

means for operatively coupling said devices and said first member and producing angular movement of said first member relative to said second member when one device is operated without operating the other device;

said coupling means for at least one of said devices including means movable along a horizontal arc with respect to said second member so as to move in a direction having a lateral component to accommodate said angular movement;

said first member being capable of being moved angularly in both directions from a position in which it lies parallel to said second member; and guide and support means underlying said vise members for supporting said vise members and for maintaining the clamping face of the first member substantially vertical during both its translational and its angular movement, and when a workpiece is clamped between the clamping faces at any position therebetween, and for restricting said lateral component of movement of said coupling means substantially to that which occurs when said one device only is operated to move said first member through its full range of angular movement;

wherein said coupling means and said guide means enable positive control by said devices of the position of the clamping faces such that a workpiece can be gripped between lineally extending portions of the clamping faces which are outboard and above the line of reaction of the devices.

2. A workbench, comprising:

two horizontal vise members lying in side by side relationship, each member having a flat upper surface, both of said surfaces lying in substantially the same plane;

a supporting structure supporting the vise members, at least one of the vise members being arranged for positive movement towards and away from the other vise member;

two elongated, laterally spaced, toothed vise operating devices having axes which define a first set of lines between which lies a medial center line when said vise members are disposed parallel to each other, said medial center line dividing said movable vise member into two lateral sides;

linking means for coupling each of said vise operating devices to said one vise member, one on each lateral side thereof and for constraining said one vise member to move in a horizontal plane substantially without tilting about any horizontal axis during clamping of a workpiece between said vise members at any point therebetween, said linking means having an original lateral position with respect to said medial center line when said vise members are parallel;

connector means for fixing the lateral position of each of said devices at one point therealong;

said linking means having portions movable with respect to said connector means, in a direction having a lateral component, to the extent that when said vise members lie at their maximum angular deviation from parallel, the lateral position of said linking means on at least one lateral side of said one vise member lies closer to said medial center line than its original position;

lateral movement limiting means for constraining said linking means against substantial movement farther from said medial center line than at said original position;

one of said vise operating devices being operable independently of the other device and said linking means being operable in conjunction with said devices during such independent operation to move one end of said one vise member more than the other end thereof to cause said vise member to lie at an acute angle with respect to each other when viewed in plan.

3. A workbench, comprising:

two vise members lying in side by side relationship and each having a horizontally elongated vertical clamping face, in opposed relationship to the other clamping face, and a flat upper surface, each of said surfaces lying substantially in a common plane;

a pair of vise operating screw threaded devices operably connecting the vise members positively to move at least one of the vise members toward and away from the other vise member, the devices being disposed at spaced positions along the length of the clamping faces;

coupling means for connecting said one vise member and said devices, said coupling means including a coupling engaging each of said device, said coupling means for one of said devices inlcuding portions that are swingable through a horizontal arc having a center at the other coupling when said one device is operated while the other device is stationary;

supporting structure inboard of the ends of the vise members for supporting the vise members from below; and guide means, including surfaces on said one vise member slidingly engaged with cooperating surfaces on said supporting structure, for constraining the vise members to maintain their clamping faces substantially vertical whilst permitting the gap between said clamping faces at one end to be greater than at the other end, said guide means being disposed at a level below said opposed clamping faces and inboard of the ends of the vise members and interconnecting said movable vise member and said supporting structure to enable said vise members, when clamping between them a vertically sided tapered workpiece positioned above the line of action of the screws and outboard of the screws when viewed in plan, to grip the vertical sides of said workpiece over a horizontally linear region thereof.

4. A workbench comprising:

two vise members lying in side by side relationship, each having a working surface lying in substantially the same horizontal plane, and each having a vertical clamping face opposed to the vertical clamping face of the other member, said opposed vertical clamping faces defining therebetween a clamping space which is open-topped and open-ended, one of said members being movable, parallel to said plane, angularly in both directions from a position in which it lies parallel to the other member;

clamping means for relatively moving the vise members translationally towards and away from one another and angularly in said horizontal plane, said clamping means including two independently operable devices operatively coupled to said one member and producing angular movement of said one member relative to the other when one device is operated without operating the other device;

supporting structure including support members having bearing surfaces defining a plane of support lying below said horizontal plane and operatively supporting said movable vise member;

one of said devices being pivotally connected at only one point to said supporting structure, thereby permitting at least one end of said one device to swing relative to said supporting structure through a horizontal arc when one of said devices is operated at a rate different than the rate at which the other device is operated, and guide means slidably engaged with said supporting structure for constraining the movable member between said planes and against all substantial tilting movement of said clamping faces away from the vertical during clamping.

5. A workbench, comprising:

first and second vise members having vertical clamping faces, each having a direction of elongation and lying in side by side relationship, and having flat upper surfaces lying substantially in a common plane;

supporting structure for supporting the vise members with their clamping faces in opposed relation;

first and second independently operable devices for moving said first vise member translationally towards and away from said second vise member and angularly in a horizontal plane, said devices including screw rods connected to said second vise member by connecting means that fix the position of one end of the screw rod in said direction of elongation with respect to said supporting structure, said screw rods extending horizontally and transverse to said clamping faces, and having the other end free to swing through a horizontal angle;

said first member being capable of being moved angularly in both directions about a vertical axis from a position in which it lies parallel to the other member, and said second vise member being rigidly connected to said supporting structure; and means including (1) cooperating surfaces on the underside of said first vise member and on the supporting structure, and including (2) first and second couplings threadedly engaged with said first and second devices, respectively, and drivingly engaging portions of said first vise member for (a) interconnecting said first vise member and said devices, and for (b) holding said first vise member down against upward movement with respect to said supporting structure, and for (c) restricting the tilting of said first vise member relative to said second vise member about a horizontal axis extending parallel to the direction of elongation of the clamping face thereof to materially less than the angular movement of said first vise member in the horizontal plane, said portion of said first vise member engaged with said first coupling being movable toward said second device in an arc centered at said second coupling when it is stationary while said first coupling is moved.

6. A workbench, comprising:

a first vise member having a clamping face which has a direction of elongation;

a second vise member having a clamping face which has a lateral direction of elongation and which faces the elongate clamping face of said first vise member;

said vise members each having a flat working surface, both of said surfaces lying in the same plane and lying above said clamping faces;

a supporting structure having supporting surfaces defining a plane of support upon which at least said first vise member is supported;

said second vise member being rigidly fastened to said supporting structure;

means for linking said first vise member and said supporting structure, while permitting said first vise member to move parallel to said plane of support both toward and away from said second vise member, and also angularly parallel to said plane with respect to said second vise member, said linking means including a. means constraining each vise member against substantial rotation relative to each other about any axis parallel to the direction of elongation of its respective clamping face; and b. means limiting the lateral component of any compound movement of any portion of said first vise member without inhibiting angular movement thereof in said plane;

said linking means including a portion fixed on said first vise member and a portion having a fixed horizontal level with respect to said supporting structure, said portions having cooperating surfaces which engage and rotate with respect to each other when said first vise member moves angularly with respect to said second vise member;

vise operating means including a pair of screw threaded rods extending transversely of said clamping faces and lying at a level below said working surface, said rods being spaced apart, one on each side of the center of the clamping face thereof in the direction of its elongation, for positively moving each end of said first vise member independently with respect to the other end thereof toward and away from the second vise member whereby the gap between the clamping faces of said two vise members may be greater at either end;

means for coupling said vise operating means and said first vise member, and having portions movable, in a direction having a lateral component, with respect to one of said vise members when said first vise member moves angularly with respect to said second vise member.

7. A workbench comprising:

a pair of elongate vise members disposed in side by side relationship;

a supporting structure for supporting the vise members;

means for constraining rotation of each vise member with respect to the supporting structure about any axis parallel to its direction of elongation;

one of the vise members being capable of movement towards and away from the other vise member;

a pair of spaced and independently operable screw threaded members;

coupling means for operatively coupling said screw threaded members between said supporting structure and said movable vise member on opposite sides of the vertical center line thereof, said coupling means including two thread engaging members each of which is engaged with a different one of said screw threaded members;

said thread engaging members and said screw threaded members being coupled together and to the movable vise member for pivoting about vertical axes to enable the movable vise member to assume different angular positions with respect to said threaded members and for positively moving the two ends of said movable vise member independently of each other towards and away from the other vise member; at least one of said thread engaging members being laterally shiftable with respect to one of said movable member and said supporting structure, in the direction of elongation of said vise members when one of said screw threaded members is turned at a rate different from the other screw threaded rod to cause the gap between the vise members at one end to be greater than the gap at the other end.

8. A workbench, comprising:

a first vise member having a vertical, elongated clamping face having a direction of elongation and a first horizontal worksurface;

a second vise member having a vertical, elongated clamping face which faces said first vise member clamping face and having a second horizontal worksurface substantially in the same plane as said first worksurface;

a supporting structure which supports the first and second vise members, and includes two horizontal support members lying generally transversely of said direction of elongation;

one of said vise members being movable with respect to said supporting structure;

two independently operable vise control devices spaced apart horizontally along said direction of elongation, each said vise control device including a toothed member and a tooth engaging member, one of which is rotatable to change the position of said tooth engaging member along the length of said toothed member;

at least one of said vise control devices having a pivotal coupling to said movable vise member and also having a pivotal connection to said support structure, said connections and couplings each having a vertical axis of rotation; and means connecting the movable vise member to the supporting structure by slidable rotation constrainers to maintain the clamping face substantially vertical while permitting rotation of the movable vise member through a horizontal angle with respect to the other vise member.

9. A workbench, comprising:

front and rear elongate vise members having opposed vertical clamping faces and lying in side by side relationship to provide a clamping space between them which is open-topped and open-ended;

the two vise members having flat top surfaces lying above the clamping faces and in substantially the same horizontal plane and when drawn together forming a working surface of the workbench;

a supporting structure for supporting said vise members, including a pair of spaced substantially parallel supports each extending transversely of the direction of elongation of the vise members, one vise member being mounted on the supports for controlled movement therealong towards and away from the second vise member;

linking means for linking each of said vise members to said supporting structure and restraining each vise member from all substantial rotation about any axis parallel to its direction of elongation;

clamping means for relatively moving the vise members translationally towards and away from one another, said clamping means comprising a pair of screw threaded members and a coupling interconnecting each of said rods and said one vise member, said rods each extending between a reaction portion of the supporting structure and said one vise member in a direction transversely of the direction of elongation of the vise members and one adjacent each of the supports, said clamping means having portions movable in an arc when said rods are differentially operated;

a foldable base structure having lower floor contacting regions and front and rear frame members each connected by upper pivotal connections to the supporting structure;

said base structure having an erected condition in which it rigidly supports the vise members at working height and a folded storage condition in which said frame members are disposed in proximity both with one another and said supporting structure.

10. A workbench including a top structure, comprising:

two vise members, each having an elongated clamping face generally facing the elongated clamping face of the other vise member;

a supporting structure underlying at least one of said vise members and operatively supporting both of said vise members;

vise operating means for positively moving said one vise member towards and away from the other vise member, said vise operating means including a pair of vise operating devices spaced apart lengthwise of the vise member clamping faces along a pair of axes having an original position when the vise members are parallel;

means operatively coupling the vise operating devices to at least said one vise member, one on each side of the center of the clamping face in its direction of elongation for enabling said vise operating means to move said one vise member to a position in which the elongate face thereof has shifted through an angle about an axis parallel to the elongated face of said one vise member and perpendicular to the direction of elongation thereof, to a nonparallel position with respect to the elongate face of the other vise member, whereby a tapered workpiece may be gripped by said vice members along the full length of the tapering faces thereof;

said coupling means on one of said devices having an original position of contact along said one vise member when said vise members are parallel, the position of contact shifting toward the axis of the other device when said one vise member is moved angularly with respect to said other vise member, to lie, at the extreme nonparallel position of said one vise member, between said original position of said axes;

means operatively interconnectng said one vise member and said supporting structure for permitting rotational movement of said one vise member about said axis and also rectilinear movement of said one vise member towards and away from the other vise member under the control of said vise operating means, including:

a) means for limiting the lateral movement of said one vise member with respect to said supporting structure to no more than the sum of the amount of inboard translation of the two ends of the clamping face of said one vise member when the vise members move from a position parallel to each other to a position of maximum angular deviation from each other and the clamping faces thereof are in contact at one point; and b) means constraining both of said vise members against rotation relative to said support structure about any axis parallel to the direction of elongation of the elongated clamping face thereof to maintain both of said clamping faces substantially vertical during clamping of a workpiece above the line of action of said vise operating devices.

11. A workbench comprising:

a pair of elongate vise members disposed in side-by-side relationship and having their upper surfaces lying in substantially the same horizontal plane to form a working surface;

a supporting structure for supporting the vise members from below;

one of the vise members being capable of movement towards and away from the other vise member;

means for constraining rotation of said one vise member with respect to said supporting structure about any axis parallel to its direction of elongation, said rotation constraining means including a downwardly facing surface on said supporting structure and an upwardly facing surface on structure associated with said vise member disposed adjacent said supporting structure, said upwardly facing surface being slidably engaged with said downwardly facing surface;

a pair of spaced and independently operable vise operating screw threaded rods for positively moving said movable vise member towards and away from the other vise member and which provide the sole control of the distribution of pressure exerted by said vise members lengthwise of the faces thereof;

two threaded receptacles, each of which is operatively coupled to a different one of said screw threaded rods, said threaded receptacles being connected to the movable vise member by vertical pivotal connections that enable a movable vise member to assume different angular positions with respect to said threaded rods;

at least one of said threaded receptacles being laterally shiftable in the direction of elongation of said vise members when one of said screw threaded rods is turned at a rate different from the other screw threaded rod to cause the gap between the vise members at one end to be greater than the gap at the other end.

12. A vise, comprising:

two elongated opposed clamping jaws having vertical clamping surfaces defining therebetween, in an open position of said jaws, a space open on both sides to receive, to be clamped, workpieces that can extend laterally beyond the jaws;

support means for supporting both clamping jaws and permitting movement of one of said clamping jaws in a horizontal plane toward and away from the other clamping jaw;

guide means for guiding said one clamping jaw and retaining the clamping surface thereof in a substantially normal condition to said horizontal plane during clamping movement of said one clamping jaw;

linking means for linking both clamping jaws to said support mean while permitting rectilinear motion of said one clamping jaw toward and away from said other clamping jaw, and also while permitting swinging motion of said one clamping jaw in said horizontal plane relative to the guide means; and two horizontally spaced apart clamping devices, including two elongated, toothed members and couplings for interconnecting the toothed members and said one clamping jaw, said devices being capable of relatively independent operation and independently acting on at least one of the clamping jaws for adjustment of the separation between clamping jaws and the angular orientation of the clamping jaws relative to each other, and for sole control of the distribution of clamping force in the direction of elongation of said clamping jaws, at least one of said clamping devices having portions which are constructed to move in an arc relative to said support means when said devices are operated to alter the angular orientation between said clamping jaws.

13. A workbench, comprising:

a top structure, including a pair of laterally elongate vise members, each having an upper work surface lying in the same horizontal plane and each having a vertically extending horizontally elongated clamping face, said faces defining therebetween a gap which is entirely clear of obstructions along the entire length and depth of said faces;

a pair of horizontally spaced support members extending transversely of the clamping faces and positioned inboard of the ends thereof, said support members lying beneath and supporting said vise members and having bearing surfaces defining a plane of support;

means for linking said vise members to said support members for movement of at least one vise member in said plane of support toward and away from the other vise member, and for securing both vise members against substantial movement out of said plane of support;

vise operating means, including two screw threaded rods, and a coupling engaged with each of said rods, each of said rods connected between said support members and said movable vise member for moving said movable vise member positively toward and away from the other vise member, said vise operating means having portions movable in an arc when said rods are differentially operated;

a supporting structure which includes a front pair of sloping members pivoted to the top structure about coincident first axes, a rear pair of sloping members pivoted to the top structure about coincident second axes, said first axes being at a lower level than said second axes, interconnecting means extending between portions of said front pair of members and said rear pair of members said interconnecting means being pivoted to said frong pair of members about coincident third axes said interconnecting means being pivoted to said rear pair of members about coincident fourth axes the distances between said first and third axes being equal to the distance between said second and fourth axes the distance between said first and second axes being equal to the distance between said third and fourth axes whereby said four axes are positioned at the corners of a parallelogram formed by the top structure, the front pair of members, the rear pair of members and the interconnecting means; and brace means extending approximately diagonally across said parallelogram.

14. A portable, foldable workbench, comprising:

two elongate vise members, each having a direction of elongation, an elongated vertical clamping face, and a flat working surface, both of said flat working surfaces lying in the same plane;

said vise members being relatively movable apart in a direction parallel to said plane and transverse to said direction of elongation with their clamping faces separated and defining between them a gap which is completely unobstructed over the entire area of the clamping faces;

said vise members also being relatively movable to bring them together with their clamping faces in contact with each other and with their flat working surfaces forming a substantially continuous planar working surface;

a supporting framework underlying both of said vise members and having bearing surfaces parallel to said plane and extending in a direction transverse to said direction of elongation at least as far as the farthest extent of separation of said vise members;

means operatively coupled to one of said vise members, including a pair of screw threaded rods lying below said working surfaces and a coupling threadedly engaged with each of said rods, for positively moving said one vise member toward and away from the other vise member by transmitting force between said supporting framework and said one vise member when said screw threaded rods are operated;

said vise moving means having portions that are movable in a horizontal arc when said rods are operated at different rates;

said other vise member being rigidly connected to said supporting framework;

each of said vise moving means being pivotally connected at one point to said supporting framework for rotation through a horizontal angle about a vertical axis and against lateral translation at said point;

said vise moving means also being pivotally connected to said one vise member for rotation through a horizontal angle relative thereto;

means linking said vise members and said supporting framework to limit the movement of said vise members relative to said supporting framework to movement parallel to said plane; and a folding leg structure having at least two leg frames connected to said supporting framework and foldable between an erected configuration in which said leg frames are spread apart and support said supporting framework at a convenient height above the floor, and a folded configuration in which said supporting framework is juxtaposed to said leg structure and said leg frames are folded compactly together.

15. A workbench, comprising:

a first vise member having a direction of elongation;

a second vise member which faces said first vise member;

said first and second vise members having flat upper surfaces which together form the complete working surface of the bench;

two horizontal support members lying generally transversely of said direction of elongation, said support members having upwardly facing bearing surfaces;

said first vise member being rigidly connected to said horizontal support members to form a rigid U-shaped upper structure;

said second vise member having portions connected thereto which are slidably supported on said bearing surfaces of said upper structure for movement towards and away from said first vise member;

a pair of spaced transversely extending vise operating devices having first reaction portions which cooperate with the upper structure, and second reaction portions which cooperate with the second vise member, said second reaction portions including connectors rotatable about vertical axes and horizontally shiftable with respect to one of said second vise members and said upper structure in a direction having a component parallel to said direction of elongation;

said vise operating devices operating in cooperation with said first and second reaction portions to cause translation of the second vise member; and a base structure which includes a pair of upright leg members pivotally connected to said workbench for supporting said upper structure above the floor at working height.

16. A portable, collapsible workbench, comprising:

two elongated vise members, each having an upper horizontal surface lying in substantially the same plane as the upper surface of the other vise member and a vertically extending clamping face disposed in opposed relationship to the clamping face of the other vise member, a bearing structure having two horizontally spaced bearing members, each of said bearing members having a bearing surface, said bearing surfaces defining a plane of support, said bearing members extending generally transversely of said clamping faces and lying inboard of the ends of said vise members;

guide means for movably connecting at least one of said vise members to said bearing structure for movement in directions parallel to said plane of support, and for restraining both of said vise members against rotational and translational movement away from said plane of support;

two toothed members, one each extending adjacent and parallel to each of said bearing members and below said bearing surfaces, each toothed member being connected adjacent one end thereof to said bearing structure against axial translation, the other end thereof being free to swing through a horizontal arc;

two tooth-engaging connectors one each engaging one of said toothed members, each connector being linked to said movable vise member for rotational movement about a vertical axis when one toothed member is operated without operating the other toothed member.

17. A workbench as defined in claim 9 wherein each of said front and rear frame members includes a pair of upright legs; and further comprising a horizontal foot-thrust member interconnecting said upright legs and lying at least partially forward of a vertical projection of said front vise member.

18. A workbench as defined in claim 9, wherein said front frame member has a pair of legs lying in a plane, and said workbench further comprises a foot-thrust member pivotally connected to said legs to fold, in said folded storage condition, to a position lying adjacent and parallel to the plane of said legs.

19. A workbench as defined in claim 9, further comprising a foot-thrust member connected to said front frame member upon which a person can stand in front of the front vise member with the vise members at substantially sawhorse height, and stabilize with his weight the workbench.

20. A workbench, comprising:

a first vise member and a second vise member, both having elongated vertical clamping faces and horizontal upper surfaces lying above said clamping faces, said vise members lying side by side with the clamping faces thereof disposed in opposed relationship;

support structure for supporting both vise members from below with the upper surfaces thereof in substantially the same horizontal plane to form a work surface;

linking means for connecting both vise members to said support structure against substantial rotation relative thereto about any horizontal axis whilst permitting rotation of at least one vise member in a horizontal plane about a vertical axis;

means including vertical surfaces on said support structure for limiting the lateral movement of said vise members relative to said support structure to less than the height of said clamping faces;

first and second vise operating devices spaced apart along the length of said clamping faces and lying at a level below said work surface;

two pivotal couplings operatively connecting said first device to each vise member for relative rotation between said first device and each vise member about vertical axes through a horizontal arc, at least one of said couplings being movable in a horizontal arc with respect to said support structure;

connection means for operatively connecting said second device to both vise members, including at least one pivotal connection that enables relative rotation between said first vise member and said second device through a horizontal arc about a vertical axis;

said devices being operable, when operated together, to move said first vise member in parallel relation to said second vise member, and when only one device is operated, to move said first vise member angularly with respect to said second vise member.

21. A workbench comprising:

a supporting structure;

a pair of vise members supported by the supporting structure, said vise members having horizontally elongated, opposed vertical clamping faces, and having horizontal upper surfaces lying above said clamping faces in substantially the same plane to form a working surface;

one of said vise members being movable with respect to the other to cause one of the clamping faces to be moved towards and away from the other clamping face;

a pair of spaced screw threaded rods operable to cause said movement;

a connection for axially securing each of said rods at one end thereof to one of said movable vise member and said supporting structure;

a pair of threaded couplings threadedly engaged, one each with each of said screw threaded rods for connecting said rods to the other of said movable member and said supporting structure, said threaded coupling being pivotally mounted for rotation about a vertical axis, said connection and said coupling each permitting arcuate movement of said screw threaded rods with respect to both the supporting structure and the movable member during operation of only one of the two screw threaded rods to cause said one member to rotate in a horizontal plane about a vertical axis relative to the other vise member, while said other vise member remains stationary with respect to said supporting structure;

guide means interconnecting the movable vise member and the supporting structure, to restrain the movable member during its rotation against substantial tilting relative to said one vise member about any horizontal axis.

22. A vise, comprising:

two horizontal vise members lying in side by side relationship and having vertical, laterally elongated clamping faces disposed in vertically and horizontally aligned opposed relationship;

a supporting structure supporting the vise members;

at least one of the vise members being arranged for positive movement towards and away from the other vise member;

two elongated, laterally spaced, toothed vise operating devices having axes which define a first set of lines between which lies a medial center line when said vise members are disposed parallel to each other, said medial center line dividing said movable vise member into two lateral sides;

linking means for coupling each of said vise operating devices to said one vise member, one on each lateral side thereof and for constraining said one vise member to move in a horizontal plane substantially without tilting about any horizontal axis during clamping of a workpiece between said vise members at any point therebetween, said linking means having an original lateral position with respect to said medial center line when said vise members are parallel;

said linking means comprising a coupling slidingly interconnecting said one vise member and said supporting structure, said coupling having upwardly facing surfaces which slidably engage downwardly facing surfaces on said supporting structure when said one vise member is moved into clamping engagement with a workpiece;

connector means for fixing the lateral position of each of said devices at one point therealong;

said linking means having portions movable with respect to said connector means, in a direction having a lateral component to the extent that when said vise members lie at their maximum angular deviation from parallel, the lateral position of said linking means on at least one lateral side of said one vise member lies closer to said medial center line than its original position;

one of said vise operating devices being operable independently of the other device and said linking means being operable in conjunction with said devices during such independent operation to move one end of said one vise member more than the other end thereof to cause said vise members to lie at an acute angle with respect to each other when viewed in plan.

23. A vise, comprising:

two horizontal vise members lying in side by side relationship and having vertical, laterally elongated clamping faces disposed in vertically and horizontally aligned opposed relationship;

a supporting structure supporting the vise members;

at least one of the vise members being arranged for positive movement towards and away from the other vise member;

two elongated, laterally spaced, toothed vise operating devices having axes which define a first set of lines between which lies a medial center line when said vise members are disposed parallel to each other, said medial center line dividing said movable vise member into two lateral sides;

said supporting structure including a pair of horizontal support members laterally spaced apart and extending transversly of said clamping faces, said support members having upper bearing surfaces lying above the level of said devices for supporting workpieces laid in the gap between said clamping faces;

linking means for coupling each of said vise operating devices to said one vise member, one on each lateral side thereof and for constraining said one vise member to move in a horizontal plane substantially without tilting about any horizontal axis during clamping of a workpiece between said vise members at any point therebetween, said linking means having an original lateral position with respect to said medial center line when said vise members are parallel;

connector means for fixing the lateral position of each of said devices at one point therealong;

said linking means having portions movable with respect to said connector means, in a direction having a lateral component, to the extent that when said vise members lie at their maximum angular deviation from parallel, the lateral position of said linking means on at least one lateral side of said one vise member lies closer to said medial center line than its original position;

one of said vise operating devices being operable independently of the other device and said linking means being operable in conjunction with said devices during such independent operation to move one end of said one vise member more than the other end thereof to cause said vise members to lie at an acute angle with respect to each other when viewed in plan.

24. The workbench defined in claim 1 wherein:

said second vise member is immovably connected to said support means; and each of said devices includes a screw threaded rod axially fixed at one end thereof to said support means and threadedly engaged with said coupling means.

25. The workbench defined in claim 1, wherein:

each of said devices includes a screw threaded rod;

connecting means for connecting each of said rods at one end thereof against axial translation with respect to one of said members;

said rods being threadedly engaged with said coupling means such that rotation of said rods about their axes will cause axial translation of said rods with respect to said coupling means, but said rods will remain axially fixed with respect to said connecting means;

said rods each being pivotally connected to said connecting means and to said coupling means for rotation through a horizontal angle with respect to said support means and both of said members when only one of said rods is operated.

26. The workbench defined in claim 1, wherein said support means includes bearing surfaces extending between said clamping faces and upon which workpieces can be laid between said clamping faces; and said devices each include a screw threaded rod extending between said clamping faces and below the level of said bearing surfaces.

27. A workbench as defined in claim 2, wherein one of said devices is a screw threaded rod, and said connector means is a swivel connection which enables said screw threaded rod to swivel in a horizontal plane about a vertical axis through said connector.

28. A workbench as defined in claim 27, wherein said connector includes an aperture in said supporting structure adjacent said other vise member through which said screw threaded rod extends, the axial position of said rod being fixed in said aperture and said vertical axis extending through said aperture.

29. A workbench as defined in claim 27, wherein said connector means is positioned adjacent one end of said screws, and the other end of at least one of said screws is free and able to swing through a horizontal arc when one of said screws is operated faster than the other of said screws.

30. The workbench defined in claim 2, wherein:

said supporting structure includes bearing surfaces which define a horizontal plane of support upon which workpieces can be laid and supported between said vise members; and said devices each include a screw threaded rod lying at a level below said plane of support.

31. The workbench defined in claim 3, wherein said other vise member is rigidly fastened to said supporting structure.

32. The workbench defined in claim 3 wherein said devices each include a screw threaded rod and said couplings are threaded onto said rods and pivotally mounted on said movable vise member for rotation about vertical pivots.

33. The workbench defined in claim 32, further comprising a connector for at least one screw threaded rod axially fixing said rod at its front end to said supporting structure while permitting said rod to swing through a horizontal arc having a center at said connector.

34. The workbench defined in claim 32, wherein said supporting structure includes a pair of support members extending transversely of said clamping faces and having upper surfaces defining a plane of support upon which workpieces can be laid between said clamping faces;

said screw threaded rods being disposed at a level below said plane of support.

35. The workbench defined in claim 3, wherein said guide means includes laterally facing vertical surfaces disposed adjacent said supporting structure to limit the lateral movement of said movable vise member with respect to said supporting structure.

36. The workbench defined in claim 3, wherein said guide means includes a slider fastened to said one vise member and having portions extending beneath and engaged with downwardly facing surfaces on said supporting structure.

37. The workbench defined in claim 4 wherein the other vise member is rigidly and immovably attached to said supporting structure.

38. The workbench defined in claim 4, wherein said devices include a screw threaded rod lying below said plane of support, and wherein said guide means comprises a coupling threadedly connected to said screw threaded rod and having upwardly facing surfaces slidingly engaged with cooperating downwardly facing surfaces on said supporting structure when said one vise member is moved to grip a workpiece between said vise members.

39. The workbench defined in claim 4, further comprising coupling means for coupling said one of said devices to said one vise member, said coupling means having portions that are pivotally connected to said one vise member for pivotal movement relative thereto about a vertical axis.

40. The workbench defined in claim 6, wherein each of said screw rods is laterally fixed with respect to said supporting structure at one point along the length of said rod and is free at one end to swing about said one point through a horizontal angle when said rods are operated at different rates.

41. The workbench defined in claim 6, wherein said supporting structure includes a pair of support members extending generally parallel to said screw threaded rods, each having a flat top portion, the upper surfaces of which form part of said supporting surfaces said screw threaded rods lying directly beneath said flat top portions.

42. The workbench defined in claim 7, wherein said other vise member is immovably fastened to said supporting structure, and each of said screw threaded members is axially secured adjacent its front end to said supporting structure by a connector, at least one of said connectors permits at least one of said screw threaded members to swivel through a horizontal arc about a vertical axis through said one connector.

43. The workbench claimed in claim 8, wherein said vise control devices each include a screw threaded rod extending transversly of said clamping faces and below their center of area.

44. The workbench claimed in claim 8, wherein said worksurfaces constitute the most elevated surfaces on said, workbench said worksurfaces forming a planar, substantially continuous worksurface when said vise members are drawn together.

45. The workbench claimed in claim 44 wherein said other vise member is rigidly fastened to said supporting structure and said movable vise member is slidably supported on said supporting structure.

46. The workbench defined in claim 9, wherein said linking means includes portions movable with respect to one of said one vise member and said supporting structure in a direction having a component in the direction of elongation of said one vise member when said screw threaded members are operated at different rates to cause said one vise member to swing through a horizontal angle with respect to the other vise member.

47. The workbench defined in claim 46, wherein:

said supporting structure includes bearing surfaces on which said vise members are supported;

said other vise member is immovably connected to said supporting structure, and said screw threaded members lie below the level of said bearing surfaces.

48. The workbench defined in claim 46, wherein:

said linking means includes laterally facing surfaces and vertically facing surfaces on said supporting structure; and said linking means further includes vertically facing surfaces on said couplings slidingly engagable with said vertically facing surfaces on said supporting structure, said couplings also including laterally facing surfaces slidingly engagable with said laterally facing surfaces on said supporting structure.

49. The workbench defined in claim 10, wherein:

said vise operating devices include a pair of screw threaded rods;

said coupling means includes a pair of threaded couplings, one each threadedly engaged with one each of said rods; and said constraining means includes portions of said coupling and said first vise member having surfaces which engage and move angularly with respect to each other when said first vise member is moved angularly with respect to said second vise member to clamp a workpiece between said vise members.

50. The workbench defined in claim 10, wherein said supporting structure underlies and provides direct vertical support for both of said vise members, and wherein the other vise member is fixedly fastened to said supporting structure.

51. The workbench defined in claim 10, wherein:

said clamping faces are of equal size and shape and are horizontally and vertically aligned;

said supporting structure includes two support members extending generally parallel to said pair of axes, said support members having upper bearing surfaces which lie below said clamping faces to support workpieces laid in the gap between said clamping faces; and said vise members include flat uppermost surfaces lying in the same horizontal plane and constituting the entire worksurface of the workbench.

52. The workbench defined in claim 11, wherein:

said other vise member is rigidly connected to said supporting structure, said screw threaded rods each being connected to said supporting structure at one end thereof against axial movement, one of said rods being free at the other end thereof to swing thru a horizontal arc about a vertical axis through its connection to said supporting structure.

53. The workbench defined in claim 52, wherein said rods lie at a level below said downwardly facing surface on said supporting structure.

54. The vise defined in claim 12, wherein said other clamping jaw is rigidly connected to said supporting structure, said toothed members include rods pivotally connected to said vise at one point against lateral movement with respect to said supporting structure, at least one of said rods having one end free to swing through a horizontal arc when said rods are operated at different rates.

55. The workbench defined in claim 20, wherein;

said support structure includes two transverse support members, each including a horizontal web having a downwardly facing surface;

said vise operating devices each include a screw threaded rod extending below said horizontal web;

said pivotal couplings each include an internally threaded slider threadedly engaged with said rods;

and said linking means includes an upwardly facing surface on each of said sliders engaged with said downwardly facing surface on said horizontal web.

56. The workbench defined in claim 55, further comprising:

a depending vertical web on each of said support members; and a set of legs pivotally connected to said vertical web and depending therefrom to support said vise members at a convenient working height above the floor.

57. The workbench defined in claim 55, further comprising:

means formed in each of said horizontal webs defining an elongate slot;

a pair of vertically extending projections for connecting each of said sliders to said first vise member, each of said projections extending through one of said slots;

said slider having portions which are wider than the width of said slot and which engage said downwardly facing surface on said horizontal web on both sides of said slot;

said lateral movement limiting means including portions on said projections which are narrower than said slot and project into said slot to permit said first vise member to move angularly with respect to said second vise member, while limiting said lateral movement.

58. The workbench defined in claim 57, wherein:

said projections extend vertically upward from said sliders an extent greater than the thickness of said horizontal webs to provide sufficient clearance between said first vise member and said support structure to enable said first vise member to ride freely in a horizontal manner along said support structure.

59. The workbench defined in claim 56 wherein:

said set of legs includes four legs;

each of two of said legs are pivotally connected to a respective one of said vertical webs directly beneath said first vise member;

each of the other two of said legs are pivotally connected to a respective one of said vertical webs directly beneath said second vise member.

60. The workbench defined in claim 20, wherein:

said vise operating devices each include a screw threaded rod;

said support structure includes downwardly facing surfaces;

said linking means, said lateral movement limiting means and said pivotal couplings are each comprised in a pair of sliders, each theadedly engaged with a respective one of said screw threaded rods and having a) a vertical projection pivotally connected to said first vise member, b) vertical surfaces engagable with said vertical surfaces on said support structure, and c) upwardly facing surfaces slidably engagable with said downwardly facing surfaces of said support structure.

61. The workbench defined in claim 20, wherein:

said vise operating devices each include a screw threaded rod; and said lateral movement limiting means provides sufficient lateral clearance to enable said first vise member to be shifted from a position parallel to and adjacent said second vise member to a position of maximum displacement from said second vise member at one end of said first vise member and in contact with said second vise member at the other end of said first vise member.

62. The workbench defined in claim 20, further comprising:

a plastic spacer positioned between said first vise member and said support structure.

63. The workbench defined in claim 20, wherein:

said pivotal couplings are connected to said first vise member on vertical axes located closer to the clamping face of said first vise member than to the opposite edge thereof.

64. The workbench defined in claim 14, wherein:

said leg frames are each connected to said supporting framework directly under a respective one of said vise members.

65. The workbench defined in claim 14, wherein:

each of said couplings is pivotally connected to said one vise member on vertical axes, said axes lying closer to said clamping face of said one vise member than to the opposite edge of said one vise member.

66. The workbench defined in claim 14, wherein:

said linking means includes guides for limiting the extent of lateral movement of said one vise member, said guides providing sufficient freedom of lateral movement of at least one end of said one vise member to enable each of said screw threaded rods, when continuously individually operated independent of the other rod, to shift said one vise member from a position parallel to and adjacent the other vise member to a position in contact with the other vise member at one end of said one vise member and maximally displaced from said other vise member at the other end of said one vise member.

67. A workbench, comprising:

a pair of laterally spaced, longitudinally extending, generally parallel support members having horizontal support surfaces defining a plane of support;

means in said support members defining a longitudinally elongated slot opening in each of said support surfaces, said slot defining means each including a pair of opposed vertical faces defining the sides of the slot;

each of said support members having a downwardly facing surface adjacent to and extending along the side of said slot;

a screw rod lying below each of said support surfaces generally parallel to said slot;

two laterally elongated vise members, each having a flat horizontal upper surface, a vertical side edge, and two end edges, said vise members being supported on said support members;

one of said vise members being slidably supported on said support members for sliding movement on said support surfaces toward and away from the other vise member and for angular movement relative thereto in a horizontal plane, the other vise member being fixedly connected to said support members;

two coupling members for coupling said one vise member to said screw rods and to said support members, said coupling members each including:

a) a threaded member threadedly engaged with a respective one of said screw rods, b) an upwardly facing surface slidingly engagable with said downwardly facing surface on said support members to limit the backward tilting movement of the clamping face of said one vise member away from a workpiece when it is clamped between said vise members, c) a vertical projection pivotally connected between said one vise member and said threaded member and projecting vertically through said slot to enable said one vise member to rotate in a horizontal plane with respect to said threaded members, said projection having vertical side surfaces engagable with at least one of said slot sides to limit the lateral movement of said moveable vise member;

at least one of said projections being narrower in the horizontal lateral direction than the lateral width of said slot to enable said coupling member to swing through a horizontal arc when only one of said screw rods is operated;

at least one of said screw rods being pivotally connected at the front end thereof to said supporting structure to enable said one screw rod to swing through a horizontal arc when only one of said screw rods is operated; and a handle connected to each screw rod at the front end thereof for hand operation of said screw rods.

68. A workbench, comprising:

first and second vise members having vertical clamping faces, each having a direction of elongation and lying in side by side relationship;

supporting structure for supporting the vise members with their clamping faces in opposed relation;

first and second independently operable devices for moving said first vise member translationally towards and away from said second vise member and angularly in a horizontal plane;

said devices each include a first and second screw threaded rod extending transversely of said clamping faces and spanning the gap therebetween, and lying below the level of the underside of said first vise member;

said first member being capable of being moved angularly in both directions about a vertical axis from a position in which it lies parallel to the other member, and means, including (1) cooperating surfaces on the underside of said first vise member and on the supporting structure, and including (2) first and second coupling means drivably coupling said first and second rods, respectively, and said first vise member for (a) interconnecting said first vise member and said devices for producing said angular movement in response to operation of said devices, and for (b) holding said first vise member down against upward movement with respect to said supporting structure, and for (c) restricting the tilting of said first vise member relative to said second vise member about a horizontal axis extending parallel to the direction of elongation of the clamping face thereof to materially less than the angular movement of said first vise member in the horizontal plane, at least one of said first and second coupling means including a portion movable in a horizontal arc relative to said supporting structure to accommodate lateral movement of said first vise member in the course of said angular movement by said first vise member.

* * * * *

UNITED STATES PATENT OFFICE

CERTIFICATE OF CORRECTION

Patent No. 4,076,229 Dated February 28, 1978

Inventor(s) Ronald Price Hickman

It is certified that error appears in the above-identified patent and that said Letters Patent are hereby corrected as shown below:

First page, Item 75, "Donald" should read --Ronald--;
Col. 1, line 55, "to member" should read --top member--;
Col. 4, line 2, "cranked handled" should read --crank handle--
Col. 7, line 14, "device" should read --devices--;
Col. 7, line 15, "inlcuding" should read --including--;
Col. 11, line 40, "vice" should read --vise--;
Col. 12, line 64, "support mean" should read --support means--;
Col. 13, line 57, "frong" should read --front--;
Col. 18, line 18, "transversly" should read --transversely--;
Col. 20, line 29, after "surfaces" insert a comma;
Col. 20, line 42, "transversly" should read --transversely--;
Col. 20, line 46, "said, workbench" should read --said workbench,--;
Col. 21, line 46, "thru" should read --through--;
Col. 21, line 65, "include" should read --includes--.

Signed and Sealed this

First Day of August 1978

[SEAL]

Attest:

RUTH C. MASON
Attesting Officer

DONALD W. BANNER
Commissioner of Patents and Trademarks